US006988387B2

(12) United States Patent
Nakaike et al.

(10) Patent No.: US 6,988,387 B2
(45) Date of Patent: Jan. 24, 2006

(54) MAKING METHOD FOR SEAMLESS METALLIC TUBE

(75) Inventors: Hirotsugu Nakaike, Kainan (JP); Kazuhiro Shimoda, Amagasaki (JP); Tomio Yamakawa, Amagasaki (JP); Toshiro Anraku, Tokyo (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/135,409

(22) Filed: May 24, 2005

(65) Prior Publication Data

US 2005/0210944 A1 Sep. 29, 2005

Related U.S. Application Data

(63) Continuation of application No. PCT/JP03/15684, filed on Dec. 8, 2003.

(30) Foreign Application Priority Data

Dec. 12, 2002 (JP) ..... 2002-360563

(51) Int. Cl.
*B21B 19/04* (2006.01)

(52) U.S. Cl. ..... 72/97; 72/209

(58) Field of Classification Search ..... 72/96, 72/97, 208, 209, 365.2, 366.2, 370.01, 370.06
See application file for complete search history.

(56) References Cited

U.S. PATENT DOCUMENTS

| | | | | |
|---|---|---|---|---|
| 5,713,234 | A * | 2/1998 | Yamakawa et al. | 72/97 |
| 6,073,331 | A * | 6/2000 | Katsumura et al. | 29/423 |
| 6,202,463 | B1 * | 3/2001 | Yorifuji et al. | 72/209 |

FOREIGN PATENT DOCUMENTS

| | | | |
|---|---|---|---|
| JP | 57-50233 | | 3/1982 |
| JP | 57-168711 | | 10/1982 |
| JP | 61-183707 | * | 7/1988 |
| JP | 63-248502 | * | 10/1988 |
| JP | 2-142604 | | 5/1990 |
| JP | 2-224805 | * | 9/1990 |
| JP | 4-147706 | * | 5/1992 |
| JP | 09-300007 | | 11/1997 |
| JP | 10-137818 | | 5/1998 |
| JP | 10-156410 | | 6/1998 |
| JP | 2002-273505 | | 9/2002 |

OTHER PUBLICATIONS

Neumann, "Stahlrohrnerstellung", German Reference, pp. 62-76 (cited in Search Report and described in specification, p. 4, beginning on line 9); c. 1970.

Edited by The Japan Society for Technology of Placity, "Boston Katachi Kan'atsutei Sekai o Lead Suru Atsutei Gijutsu", Koronasha Kabushiki Kaisha, p. 151 (cited in Search Report); Aug. 20, 1991.

* cited by examiner

*Primary Examiner*—Ed Tolan
(74) *Attorney, Agent, or Firm*—Clark & Brody

(57) ABSTRACT

The present invention relates to a making method for a seamless metallic tube with a tilting roll type piercing rolling mill (piercer). According to the making method for a seamless metallic tube of the present invention, the rotary forging effect and the circumferential shearing strain can be significantly suppressed without generating uncompleted engagement of a billet. Accordingly, a product having reduced inside defects and excellent inside quality can be produced in high productivity. Further, by strengthening a plug nose rolling portion, a sharpened plug nose is obtained and an engagement limit can be increased. Additionally, a product further excellent in the inside quality can be efficiently produced. Accordingly, the present invention can be applied to wide fields of the piercing rolling of the seamless metallic tube.

14 Claims, 8 Drawing Sheets

MAKING METHOD FOR SEAMLESS METALLIC TUBE

This application is a continuation of International Patent Application No. PCT/JP2003/015684, filed Dec. 8, 2003. This PCT application was not in English as published under PCT Article 21(2).

BACKGROUND OF THE INVENTION

1. Field of the Invention

The present invention relates to a making method for a seamless metallic tube, and more specifically relates to a piercing rolling method for a seamless metallic tube with a tilting roll type piercing rolling mill.

2. Description of the Related Art

In a Mannesmann tube-making method, which has been widely used in a making method for a seamless metallic tube, a solid round billet (hereinafter referred to as only "billet") heated at a desired temperature, which is used as a raw material, is supplied to a tilting roll type piercing rolling mill (hereinafter referred to as only "piercer") to pierce a hole in the axis center portion thereby obtaining a hollow tube stock.

Then, the obtained hollow tube stock is stretching rolled with a subsequent stretch roll mill, such as a plug mill, a mandrel mill or the like, as it is or after optionally setting the diameter of the tube stock by enlarging or reducing the diameter of tube stock by passing the hollow tube stock to an elongater mill or a shell sizer having the same configuration as said piercer. Then it is subjected to a refining process including tube-polishing, shape-correcting or sizing with finishing roll mills such as a stretch reducer, a reeler, a sizer and the like to make a product tube.

FIG. 1 is a perspective view showing a configuration example of a piercer used in a Mannesmann tube-making method. The piercer is constructed so that it includes a pair of barrel type main rolls 1, 1 oppositely disposed while being inclined to the opposite direction each other with axis-symmetrically arranging to a pass line X—X, which is a supply line for a billet 4 that is a material to be pierced, and further includes a pair of disk rolls 2, 2 oppositely disposed with axis-symmetrically arranging to said pass line while the phases of the disk rolls are differentiated from those of these main rolls 1, 1 by 90° as well as a plug 3 is supported on the pass line X—X with a mandrel.

The nose (tip) of the plug 3 is usually disposed such that it is positioned at a rolling upstream side than a gorge 6 where the distance between the main rolls 1, 1 is minimum, and a distance (for example, PL shown in FIG. 4, which will be described later) protruded from the gorge 6 is called as a plug lead.

In the piercer constructed as mentioned above, the main rolls 1, 1 are rotated in the same direction with an inclination angle β with respect to the pass line X—X. Consequently, the billet 4 supplied in an arrow direction along the pass line X—X is moved spirally after engagement between the main rolls 1, 1 so that it is hollowed at the axis center portion of the billet to obtain a hollow tube stock.

In the step the disk rolls 2, 2 act as a guide member of the rolling billet 4 and at the same time act an outer diameter-shape corrector by suppressing the bulging of the hollow tube stock pierced by the plug 3 in a 90° phase direction with an opposite direction of the main rolls 1, 1. Further, these disc rolls 2, 2 are rotation-driven in the same direction as a billet 4 feed direction so that sliding between pierced hollow tube stock and the rolls is reduced and no scoring occurs.

Further, the piercers include a piercer, whose main rolls 1, 1 each has a cone type shape, called as an intersection type one, which forms an intersection angle γ, which is different from the above-mentioned inclination angle β by disposing the roll axis center so that it is closer on the inlet side and farther on the outlet side with respect to the pass line X—X (refer to FIG. 11B, which will be shown later).

In recent years even in a material having less workability such as a high alloy steel, stainless steel or the like, rolling of a metallic tube has been performed by use of Mannesmann tube-making method. Therefore, the above-mentioned plug 3 is strongly required for performance of a long service life and performance that inside defects are not generated in the hollow tube stock.

To suppress the inside defects, which are generated in the hollow tube stock, it is indispensable to suppress (a) the generation of rotary forging effect and (b) the generation of circumferential shearing strain as described in Japanese Patent Application Publication No. 57-168711. These phenomena of (a) and (b) are peculiar phenomena of a piercer. Thus as long as these phenomena are suppressed, a material having less workability such as a high alloy steel, stainless steel or the like cannot be worked to tubes efficiently by the Mannesmann tube-making method. Further extension of the service life of a plug used is also difficult.

The above-mentioned Japanese Patent Application Publication No. 57-168711 discloses a method of suppressing the above mentioned (a) and (b) by controlling the inclination angle β and intersecting angle γ. However, in the publication not only an elongation of the service life of the plug but to cause the plug itself to have functions of suppressing the above-mentioned (a) and (b) are not considered at all.

Further, Japanese Patent Application Publication No. 10-137818 proposes a plug shape by which a service life can be extended even if a plug is used in piercing rolling of a material having less workability such as a high alloy steel, stainless steel or the like. FIG. 2 is a view showing plug shapes proposed in Japanese Patent Application Publication No. 10-137818.

As shown in FIG. 2, the proposed plug is a plug called as a shell-shaped plug, whose entire shape is simple, so called as 2-zone type plug (hereinafter referred to as "2-zone type plug"). The relationships between only r, R and D of the sizes of respective portions of the plug shown in FIG. 2 were defined as plugs of shapes, which satisfy the conditions shown in the following expressions (5) to (7). Thus, to cause the plug itself to have functions of suppressing the above-mentioned (a) and (b) is not considered at all.

$$R \geqq -160r+12D \tag{5}$$

$$R \geqq 18r+3.6D \tag{6}$$

$$-20r+22D \geqq R \geqq 90r-15D \tag{7}$$

FIG. 3 is a view showing another plug shape proposed as a plug of a long service life. This plug has been proposed by a Germany reference (by Neumann "Stahlrohrnerstellung (production of steel tube; German reference)", 1970) and has a structure in which between a front end portion having a curvature radius of r and an axial length of L1 and a work portion of an axial length L3, which is an arc rotating surface of a curvature radius of R, was formed a cylindrical parallel portion having an outer diameter of d and an axial length of L2 and an front end rolling portion comprising this parallel portion and said front end portion was formed.

Since the plug having a shape shown in FIG. 3 has such a structure that a gap where a material to be pierced does not contact the vicinity portion of the work portion in the front end rolling portion is formed and heat accumulated within the plug is discharged, the tip of the plug is difficult to dissolve thereby extending the service life of the plug.

Thus, the present inventors performed use comparison tests between said 2-zone type plug shown in FIG. 2 and the plug having the shape shown in FIG. 3. As a result it has been confirmed that the plug having the shape shown in FIG. 3 has a slightly longer service life and inside defects, which are more difficult to occur than the other, but there are problems that uncompleted engagement is liable to occur and reducibility is reduced.

SUMMARY OF THE INVENTION

The present invention was made in consideration to the above-mentioned circumstances. The object of the present invention is to provide a making method for a seamless metallic tube, in which when a plug lead is decreased to prevent the occurrence of uncompleted engagement in the use of the plug of a shape shown in FIG. 3, in other words, even if a draft ratio of the plug nose is increased, a product in which occurrence of inside defects is slight can be obtained. At the same time the object of the present invention is to provide a making method of a seamless metallic tube, which can increase the plug engagement limit without generating the dissolution of the plug.

FIG. 4 is a view explaining a plug lead in piecing rolling of a hollow tube stock and draft ratios of the plug nose. In the explanation of the present invention as shown in FIG. 4 a plug lead PL means a distance from a position of a gorge 6 of the cone type main roll 8 to the tip of the plug 3.

Further, the reduction at plug nose PDR (%) is a value defined by the following expression (8) when defining the outer diameter of the billet 4 as BD and the shortest distance between the main rolls 8, 8 at a position of the plug 3 tip. It is noted that RO in FIG. 4 is the shortest distance between the main rolls 8, 8 at a position of the gorge 6.

$$PDR=\{(BD-ROP)/BD\}\times 100\ (\%) \tag{8}$$

Therefore, when the plug is set so that the plug lead PL is decreased in FIG. 4, a value defined by the above expression (8) is increased accordingly. Thus, as mentioned above, a case where the plug lead is set to be small can be said in other words as a case where the reduction at plug nose is set to be large.

The present invention has been developed to attain the above-mentioned objects. The gist of the present invention is the following tube-making methods (1) and (2) of seamless metallic tubes.

(1) A making method (hereinafter referred to as the first method of the present invention) of a seamless metallic tube of piercing rolling a solid round billet of an outer diameter BD (mm) with a tilting roll type piercing rolling mill by use of a plug having:

a nose rolling portion comprising a cylindrical portion with an axial length of L2 (mm) whose outer diameter d (mm) is equalized in the axial direction or whose outer diameter d is increased toward the rear end of the cylindrical portion in the axial direction while having a half angle in the cone angle of 2° or less, and a tip spherical portion having a curvature radius of r (mm) and an axial length of L1 (mm), a working portion of an axial length of L3 (mm), continued to said nose rolling portion and formed by an arc rotating surface of a curvature radius of R (mm) so that the outer diameter is increased toward the axial rear end of the working portion, and a tapered cylindrical reeling portion of an axial length of L4 (mm), continued to said working portion and formed by a cone angle of 2 θ (°), so that the outer diameter is increased toward the maximum outer diameter D (mm) on the axial rear end of the reeling portion, characterized in that the relationships between the outer diameter d, the curvature radius R, and the axial lengths L1, L2 and L3 of said plug and the outer diameter BD of said solid billet satisfy all of the following expressions (1) to (3).

$$0.12\leqq d/BD\leqq 0.35 \tag{1}$$

$$0.020\leqq(d/2BD)/(R/L3)<-0.046 \tag{2}$$

$$0.5d\leqq -L1+L2\leqq 3d \tag{3}$$

(2) A making method (hereinafter referred to as the second method of the present invention) of a seamless metallic tube of piercing rolling a solid round billet of an outer diameter BD (mm) with a tilting roll type piercing rolling mill by use of a plug having:

a nose rolling portion comprising a cylindrical portion with an axial length of L2 (mm) whose outer diameter d (mm) is equalized in the axial direction or whose outer diameter d is increased toward the rear end of the cylindrical portion in the axial direction while having a half angle in the cone angle of 2° or less, and a tip spherical portion having a curvature radius of r (mm) and an axial length of L1 (mm), a working portion of an axial length of L3 (mm), continued to said nose rolling portion and formed by an arc rotating surface of a curvature radius of R (mm) so that the outer diameter is increased toward the axial rear end of the working portion, and a tapered cylindrical reeling portion of an axial length of L4 (mm), continued to said working portion and formed by a cone angle of 2 θ (°), so that the outer diameter is increased toward the maximum outer diameter D (mm) on the axial rear end of the reeling portion, and in which tensile strength of at least said nose rolling portion at 1100° C. is 50 MPa or more characterized in that the relationships between the outer diameter d, the curvature radius R, and the axial lengths L1, L2 and L3 of said plug and the outer diameter BD of said solid billet satisfy all of the following expressions (2) to (4).

$$0.06\leqq d/BD\leqq 0.12 \tag{4}$$

$$0.020\leqq(d/2BD)/(R/L3)-<0.046 \tag{2}$$

$$0.5d\leqq L1+L2\leqq 3d \tag{3}$$

In the second method of the present invention it is preferable that the nose rolling portion of the plug is replaceable. Further, it is also preferred that as a member of the nose rolling portion of the plug a base material forming the working portion and the reeling portion and scale are used and the thickness of the scale of the nose rolling portion is in a range of from 1.5 times to 3 times the thickness of the scale of said working portion and reeling portion.

In the first and second methods of the present invention from a viewpoint of ensuring excellent service life it is preferable that the scale thickness of the base material forming the working portion and the reeling portion is in a range of 200 μm to 1000 μm.

Further, in first and second methods of the preset invention as a tilting roll type piercer an intersecting type, tilting roll type piercer whose main roll shape is a cone type and in which the distance between the roll axis center and the pass line is small on the inlet side and large on the outlet side, is preferably used. In this case the productivity can be further enhanced.

BRIEF DESCRIPTION OF THE DRAWINGS

Preferred embodiments of the present invention will now be described in detail, by way of example only, with reference to the accompanying drawings, in which.

DETAILED DESCRIPTION OF THE PREFERRED EMBODIMENTS

The reasons why the present invention was defined as mentioned above will be described by separating it to the first and second methods of the present invention based on attached drawings.

1. First Method of the Present Invention

As mentioned above, the generation of inside defects in piercing rolling with a piercer is derived from (a) the generation of rotary forging effect and (b) the generation of circumferential shearing strain. Specifically, rotary forging effect is generated at the billet axis center on more upstream side than the tip of a plug, and this rotary forging effect is subjected to circumferential shearing strain generated during wall thickness working with main rolls and a plug, resulting in the generation of an inner flaw in accordance with the growth of deformation generated.

Figure 1:
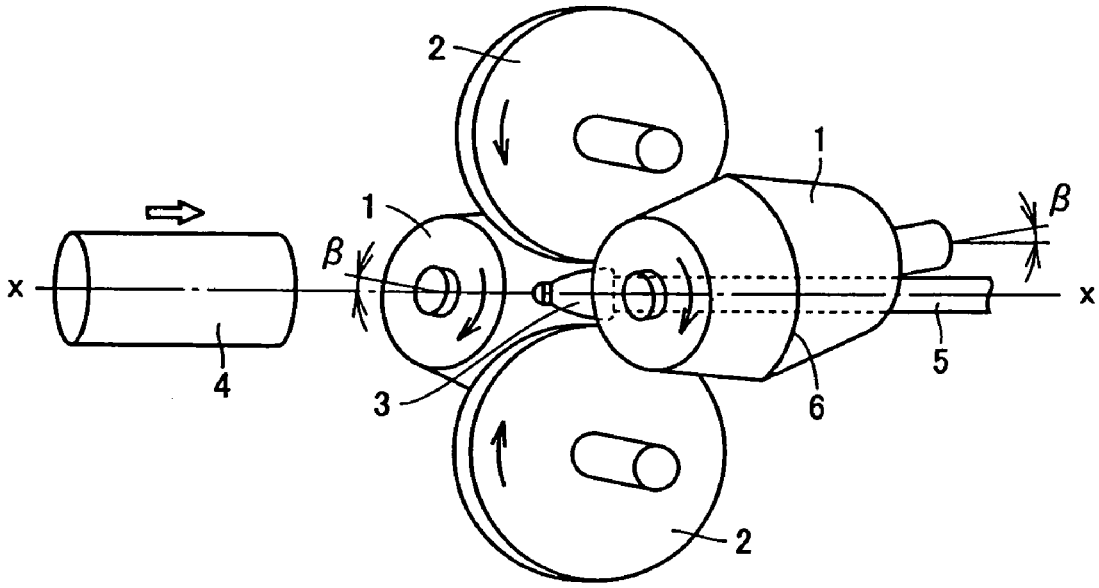
FIG. 1 is a perspective view showing a configuration example of a piercer used in a Mannesmann tube-making method.
Figure 2:
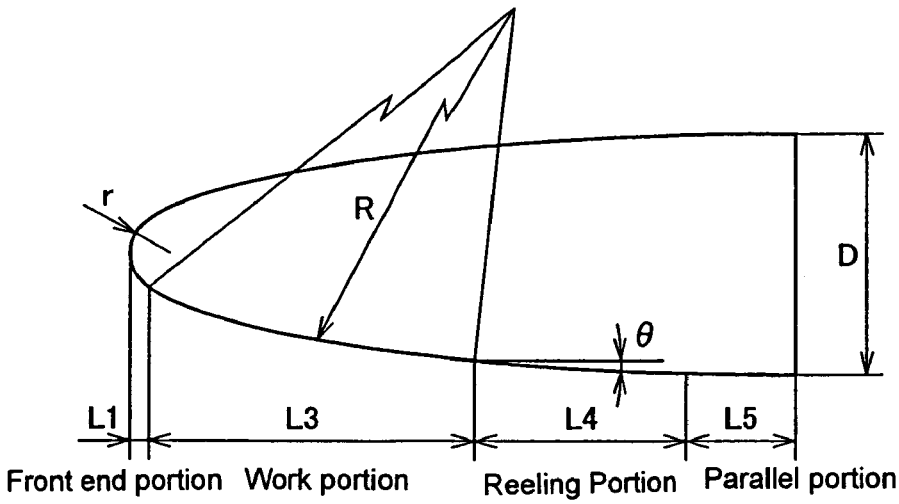
FIG. 2 is a view showing one example of a 2-zone type plug whose entire shape is simple and shell-shaped.
Figure 3:
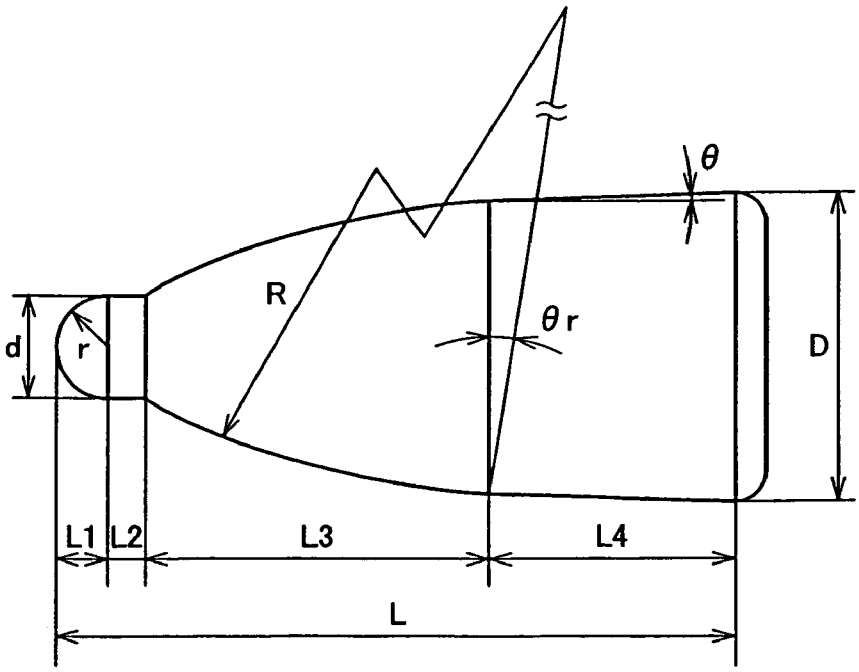
FIG. 3 is a view showing a shape of a plug used in the present invention.
Figure 4:
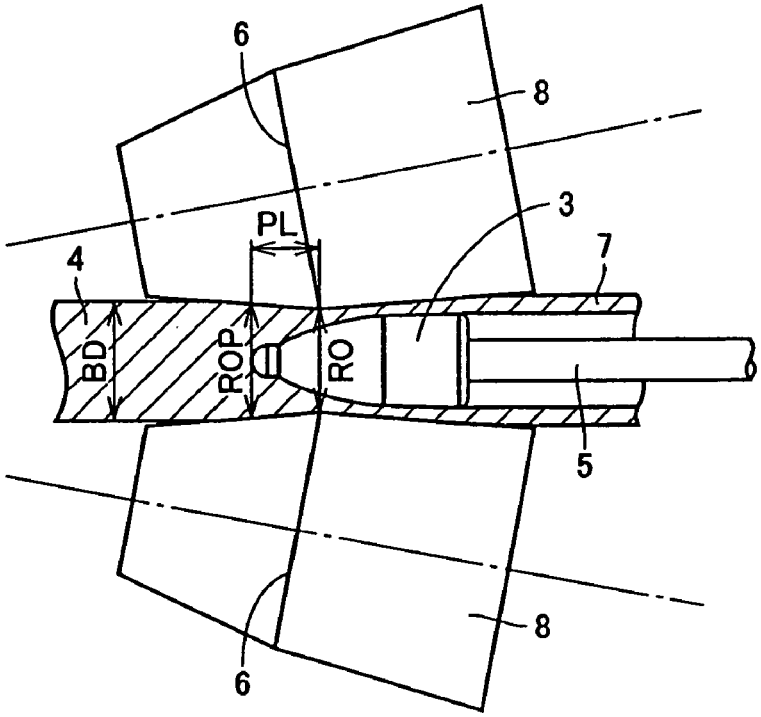
FIG. 4 is a view showing a plug lead in piercing rolling of a hollow tube stock and reduction at plug noses.

Accordingly, the present inventors performed experiments of piercing rolling by various conditions using a model mill to grasp the conditions of (a) the generation of rotary forging effect and (b) the generation of circumferential shearing strain when using a plug of a shape shown in FIG. 3.

Here, the plug of the shape shown in FIG. 3 has a nose rolling portion comprising a cylindrical portion with an axial length of L2 whose outer diameter is d and a nose spherical portion having a curvature radius of r and an axial length of L1, a working portion of an axial length of L3, continued to the nose rolling portion and formed by an arc rotating surface of a curvature radius of R so that the outer diameter is increased toward the axial rear end of the working portion, and a tapered cylindrical reeling portion of an axial length of L4 continued to the working portion and formed by a cone angle of 2 θ, so that the outer diameter is increased toward the maximum outer diameter D on the axial rear end of the reeling portion.

Figure 5:
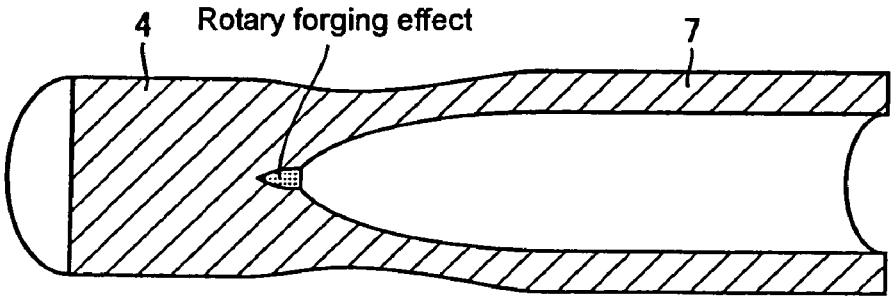
FIG. 5 is a view explaining a method of checking the occurrence conditions of rotary forging effect by a model mill.

FIG. 5 is a view explaining a method of checking the occurrence conditions of rotary forging effect by a model mill. In an experiment of a model mill a billet of a lead free-cutting steel was used. As shown in FIG. 5, the occurrence conditions of rotary forging effect immediately in front of the nose of a plug were checked by stopping piercing midway and cutting the obtained material longitudinally. The obtained material was divided into a portion of a billet 4 and a portion of hollow tube stock 7.

Figure 6A:
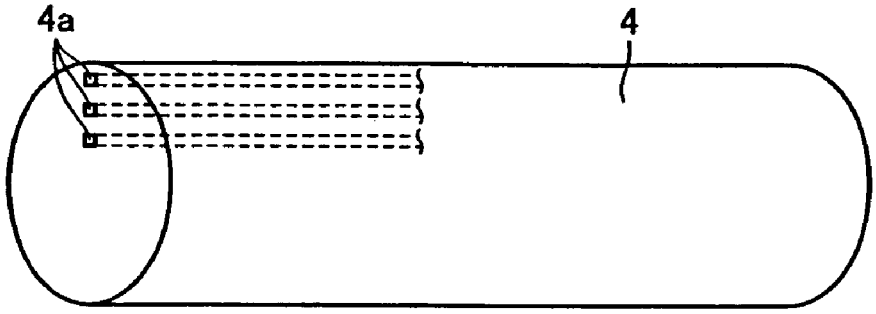
FIG. 6 is a view explaining a method of checking the occurrence conditions of circumferential shearing strain by a model mill.
Figure 6B:
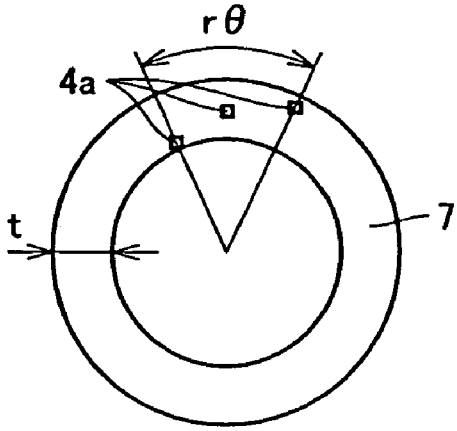

FIG. 6 is a view explaining a method of checking the occurrence conditions of circumferential shearing strain by a model mill. Particularly, (a) is a perspective view of a billet and (b) is a view showing an end surface of a hollow tube stock. The occurrence of circumferential shearing strain was checked by burying pins 4*a* at three positions on a radius line of the billet 4 by electrical discharge machining, piercing it and observing cross-sectional surfaces of the obtained hollow tube stock 7 after picking the billet to confirm the positions of the three pins 4*a*.

Figure 7:
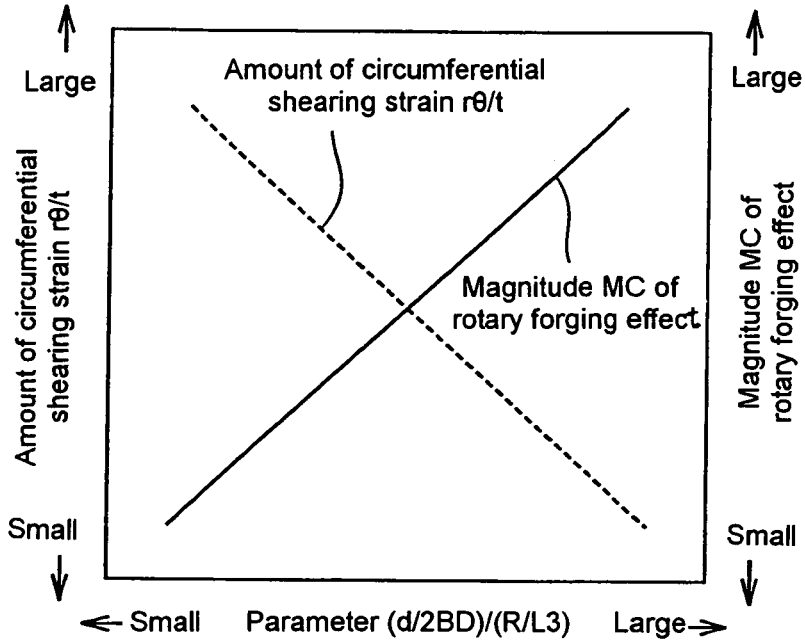
FIG. 7 is a view showing the relationships between a parameter "(d/2BD)/(R/L3)" for specifying the shape of the plug shown in FIG. 3, an amount of circumferential shearing strain (rθ/t), and magnitude MC of rotary forging effect.
Figure 8:
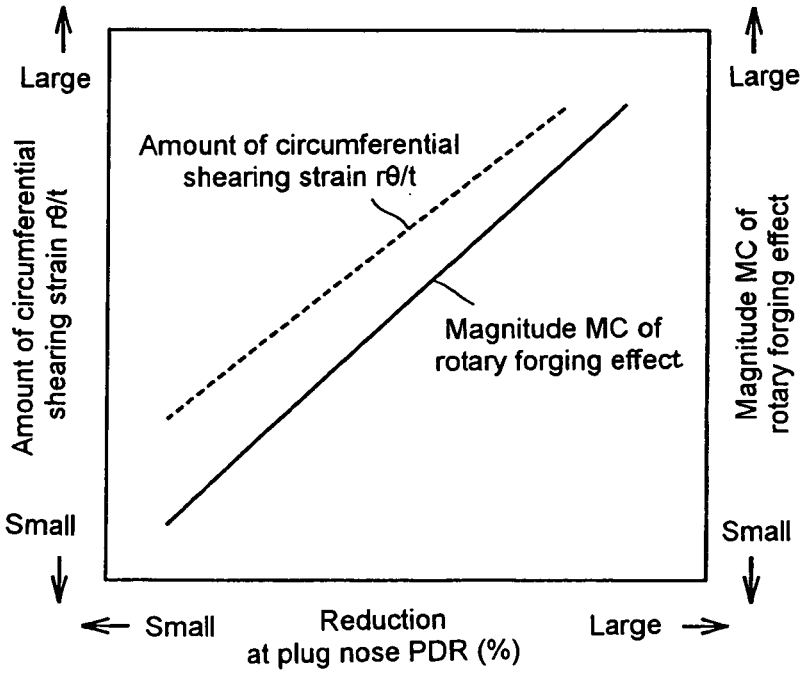
FIG. 8 is a view showing the relationships between a reduction at plug nose PDR (%), an amount of circumferential shearing strain (rθ/t), and magnitude MC of rotary forging effect, when reduction at plug noses PDR (%) were variously changed.

FIGS. 7 and 8 are views explaining check results by a model mill conceptually.

First, FIG. 7 is a view showing the relationships between "(d/2BD)/(R/L3)", which is a parameter of an amount of free-dimension prepared by the preset inventors for specifying the shape of the plug shown in FIG. 3, an amount of circumferential shearing strain (rθ/t), and magnitude MC of rotary forging effect. In FIG. 7 as the above-mentioned parameter "(d/2BD)/(R/L3)" is decreased, the shape of the plug becomes sharp and as the parameter is increased it becomes dull.

Next, FIG. 8 is a view showing the relationships between a reduction at plug nose PDR (%), an amount of circumferential shearing strain (rθ/t), and magnitude MC of rotary forging effect, when reduction at plug noses PDR (%) were variously changed.

As shown in FIG. 8, as the reduction at plug noses PDR (%) are increased, there are such relationships that the amount of circumferential shearing strain (rθ/t), and magnitude MC of rotary forging effect are also increased.

In the relationships shown in FIG. 7, the smaller the parameter "(d/2BD)/(R/L3)" is the further rotary forging effect is suppressed. This reason is that as the shape of the plug becomes sharp an axial reaction force on a billet from the plug is decreased to increase an advancing speed of the billet whereby the time since when the billet is engaged with the main rolls until the billet reaches the tip of the plug is decreased. As a result a number of rotary forging is reduced so that the rotary forging effect is difficult to occur.

On the contrary the larger the parameter "(d/2BD)/(R/L3)" is the further the amount of circumferential shearing strain (rθ/t) is suppressed. The reason for this will be described with reference to FIG. 9.

Figure 9:
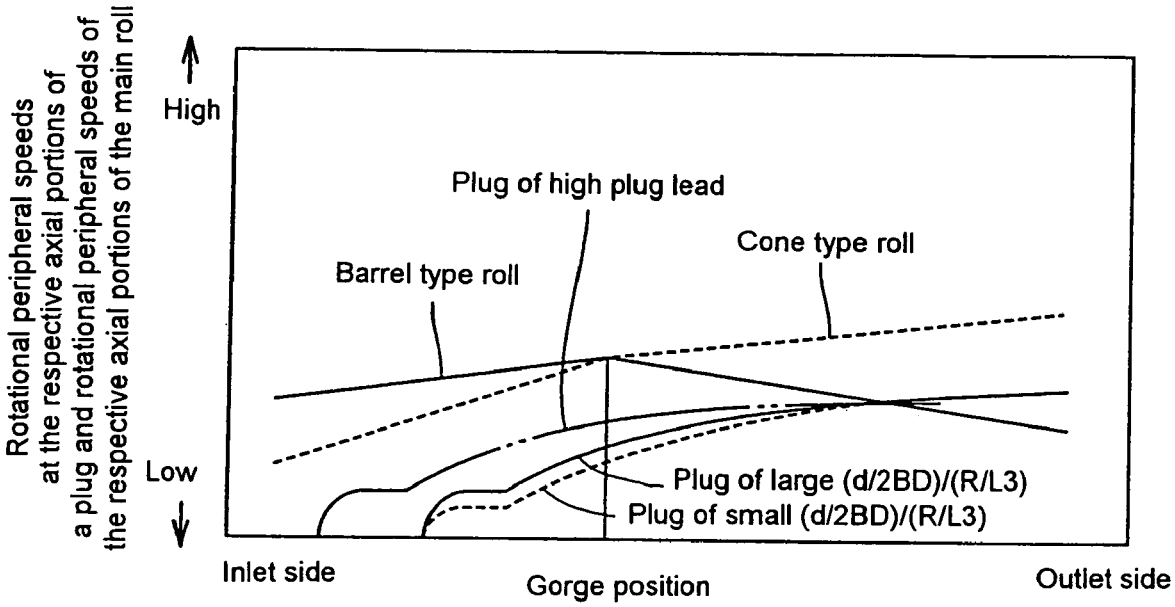
FIG. 9 is a view showing rotational peripheral speeds at the respective axial portions of a plug in a piercing rolling process and rotational peripheral speeds of the respective axial portions of the main roll.

FIG. 9 is a view showing rotational peripheral speeds at the respective axial portions of a plug in a piercing rolling process and rotational peripheral speeds of the respective axial portions of the main roll. As shown by dotted lines in FIG. 9, when the parameter "(d/2BD)/(R/L3)" is reduced, a difference in rotational peripheral speeds between the main roll and the plug at a working portion of the plug is increased until a gorge position where wall thickness rolling is performed and accordingly, the amount of circumferential shearing strain (rθ/t) is increased.

On the other hand, as shown by solid lines in FIG. 9, when the parameter "(d/2BD)/(R/L3)" is increased, the difference in rotational peripheral speeds between the main plug and the plug is decreased and accordingly, the amount of circumferential shearing strain (rθ/t) is also reduced.

Further, although rolls are sectioned to a barrel type roll (shown by the solid line) and a cone type roll (shown by the dotted line) in FIG. 9, the rotational peripheral speed of a barrel type mail roll becomes maximum at a gorge position and is decreased as it goes toward the inlet side and the outlet side.

On the contrary the rotational peripheral speed of the cone type main roll is increased as it goes from the inlet side toward the outlet side. Therefore, a difference in the rotational peripheral speeds between the main roll and plug is reduced in a case where the main roll is the cone type.

Thus, in a case of the plug where the above-mentioned parameters "(d/2BD)/(R/L3)" are the same, when a piercer including cone type main rolls is used, the occurrence of circumferential shearing strain can be significantly suppressed.

Further, to minimize the difference in the rotational peripheral speeds between the main roll and the plug there is such a method that the plug lead PL from the gorge position is increased, that is the plug chip draft ratio PDR is reduced as shown by the chain double-dashed line in FIG. 9.

Since the distance from where the billet is engaged with main rolls to where it reaches the tip of the plug is reduced, the occurrence of rotary forging effect is suppressed. However, in this case, the billet is liable to generate uncompleted engagement.

It has been found that in the dimensions of the respective portions of the plug having shapes shown in FIG. 3, when the outer diameter d of the nose rolling portion is 0.35 or less times the outer diameter of the billet, the axial length L1+L2 is 0.5 or more times d, and the plug has such a shape that the value of the parameter "(d/2BD)/(R/L3)" satisfying the above conditions and the curvature radiuses R and L3 takes 0.046 or less, even if the reduction at plug nose PDR is reduced to a limit value of the 2-zone type plug or more, uncompleted engagement is not generated and rotary forging effect and circumferential shearing strain are suppressed so that a hollow tube stock having no inside defects can be produced.

However, if the outer diameter d of the nose rolling portion is set to 0.12 or less times BD, the nose rolling portion becomes easy to dissolve so that the service life of the plug is reduced. Further, when a value of L1+L2 is set to three or more times d, the nose rolling portion is liable to deform and the entire length of the plug is too long to set a normal plug.

Further, when a plug takes a shape in which R and L3 satisfies the parameter "(d/2BD)/(R/L3)" of less than 0.020, it has been found that an effect of suppressing occurrence of a circumferential shearing strain cannot be obtained further than in 2-zone type plug.

Therefore, in the first method of the present invention, when the outer diameter of the billet is BD, a plug of a shape, in which at least said outer diameter d, curvature diameter R and axial lengths L1, L2 and L3 in the dimensions of the respective portions of the plug having a shape shown in FIG. 3, satisfy the following expressions (1) to (3), was used.

$$0.12 \leqq d/BD \leqq 0.35 \quad (1)$$

$$0.020 \leqq (d/2BD)/(R/L3) \leqq 0.046 \quad (2)$$

$$0.5d \leqq L1+L2 \leqq 3d \quad (3)$$

It is noted that a curvature radius r of a nose sphere of a plug, whose axial length forms a nose rolling portion of L1+L2 is most preferably set to 0.5d (L1=r). However, a condition r=0.5d is not necessarily needed, and even a condition r>0.5d may be set. Nevertheless, when r is excessive, the tip surface gets close to a flat surface and an axial reaction force on the billet from a plug is increased to reduce the advancing speed of the billet. Thus since a number of rotary forging is increased and rotary forging effect is liable to occur, it is preferable that the upper limit of r is set to at most r=d.

Further, an cylindrical portion of the outer diameter d of the nose rolling portion and an axial length L2 is not necessarily equalized in the axial direction, and in consideration of reuse by repeating free-cutting and thermal treatment a tapered cylindrical plug having 2° or less which is half angle for a cone angle, which is increased from an axial tip of the plug with an outer diameter of d toward the rear end, may be used.

Further, the reeling portion is a region provided for making the wall thickness of the material constant and wall thickness machining is not positively performed in this case. Thus, it is preferable that an angle in the reeling portion is substantially equalized to an interfacial angle on the roll outlet side.

2. Second Method of the Present Invention

As shown in FIG. 8, to suppress the occurrence of rotary forging effect in the piercing process of a billet to produce a hollow tube stock having no flaws it is effective to reduce a reduction at plug nose PDR (%) at the setting and to enhance the piercing efficiency at the same time. Reduction at plug nose PRD (%) decreases the distance from a position where the billet is engaged with main rolls to the nose of the plug so that a number of rotary forging is reduced. As a result the occurrence of rotary forging effect is suppressed.

When an axial component of a billet speed in rolling roll outlet side is set to Vs, an axial component of the roll circumferential speed is set to Vr and an inclination angle of the main roll is set to 8, the piercing efficiency FE is defined by the following expression (9).

$$FE = Vs/Vr \times \sin\beta \times 100(\%) \quad (9)$$

Improvement of piercing efficiency also permits reduction in a number of rotary forging and reduction in the occurrence of rotary forging effect.

However, if the reduction at plug nose PDR (%) is minimized, a billet is liable to generate uncompleted engagement. Thus the reduction of the reduction at plug nose PDR (%) has a limit of engagement. When uncompleted engagement is generated, stopping of an operation of the piercer becomes unavoidable, resulting in significant reduction of productivity.

On the contrary according to the review of the present inventors, it has become clear that when a plug nose rolling portion of the plug having a shape shown in FIG. 3 is further tapered to improve the plug shape, an engagement limit can be increased and a high percing efficiency FE can be maintained in a state where the reduction at plug nose PDR (%) was reduced.

However, when the plug nose rolling portion is further tapered the nose rolling portion is easy to dissolve while lowering heat capacity. Therefore, a further review was performed and it became clear that if a desired high temperature can be ensured at a plug nose rolling portion, even if the plug nose portion is further tapered, it is not dissolved and an engagement limit can be increased.

Specifically, tensile strength in at least a plug nose rolling portion at 1100° C. can be set to 50 MPa or more. Here the reason why an aim temperature is set to 1100° C. is that the temperature is an maximum temperature at which a member forming a plug nose rolling portion with a scale formed on the surface can be heated.

The reason why required strength is set to 50 MPa or more is that the plug nose rolling portion was required for having strength of 1.2 to 2 or more times as compared with tensile strength of a 3% Cr—1% Ni steel used as a general plug material at 1100° C. That is if a superiority of said strength or more cannot be ensured, no priority can be found in the plug service life in a model mill test, which will be described later.

In the second method of the present invention, the above-mentioned high temperature strength must be ensured in at least a plug nose rolling portion. Therefore, as long as a plug used here satisfies this condition, portions except for the plug nose rolling portion, that is base material portions forming a working portion and a reeling portion, which have usual plug strength, may be used.

Based on the above-mentioned knowledge, when a plug having a shape in which an outer diameter d of a plug nose rolling portion is 0.12 or less times an outer diameter BD of a billet, the axial length L1+L2 is 0.5 or more times d, and the curvature radius R and the L3 satisfies 0.046 or less in the parameter (d/2BD)/(R/L3) in the respective sizes of the plug of a shape shown in FIG. 3, is used, even if the reduction at plug nose PDR is reduced to a limit value or more of the plug used in the first method of the present invention, a tube stock in which no uncompleted engagement occurs, no dissolution of the nose rolling portion can be found and no inside defects can be found, could be efficiently produced.

On the other hand, when the outer diameter d is set to less than 00.6 times BD like the above-mentioned first method of the present invention, even if the plug nose rolling portion is strengthened by any manner, the plug is liable to dissolve due to small heat capacity. Further, when the axial length L1+L2 is 3 or more times d, the plug nose rolling portion is liable to deform and the entire length of the plug is too long to set a normal plug.

Further, when a plug takes a shape in which R and L3 satisfies the parameter "(d/2BD)/(R/L3)" of less than 0.020, an effect of suppressing of circumferential shearing strain cannot be obtained further than in 2-zone type plug.

Therefore, in the second method of the present invention, when the outer diameter of the billet is BD, a plug of a shape, in which at least said outer diameter d, curvature diameter R and axial lengths L1, L2 and L3 in the sizes of the respective portions of the plug having a shape shown in FIG. 3, satisfy the following expressions (2) to (4), was used.

$$0.06 \leqq d/BD \leqq = 0.12 \quad (4)$$

$$0.020 \leqq (d/2BD)/(R/L3) \leqq \mathbf{0.046} \quad (2)$$

$$0.5d \leqq L1+L2 \leqq 3d \quad (3)$$

In a plug used in the second method of the present invention, a portion, which requires a desired high temperature strength, is the plug nose rolling portion. Thus, it is effective to divide the plug into a member used as its nose rolling portion and a base material forming a working portion and a reeling portion.

Therefore, in the production of a plug any of an internal chill method and an assembly method can be applied. However, a method of forming a plug nose rolling portion by buildup welding cannot be adopted as a plug-making method since the base portion is heat-affected.

Figure 10A:
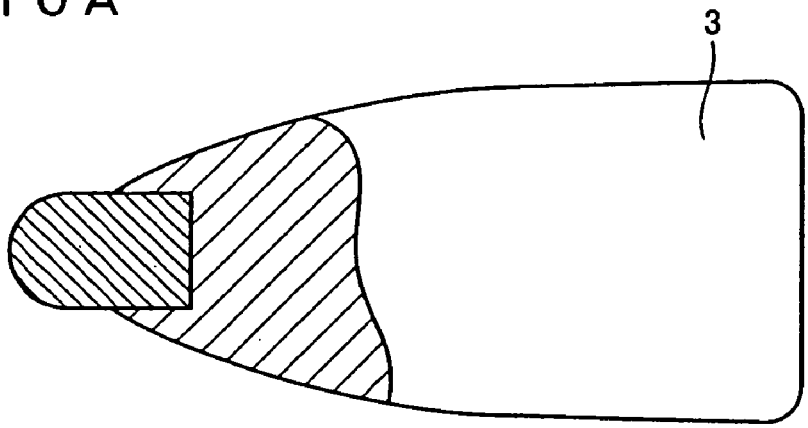
FIGS. 10A and 10B are views showing an example of a configuration of a split plug produced by an assembly method.
Figure 10B:
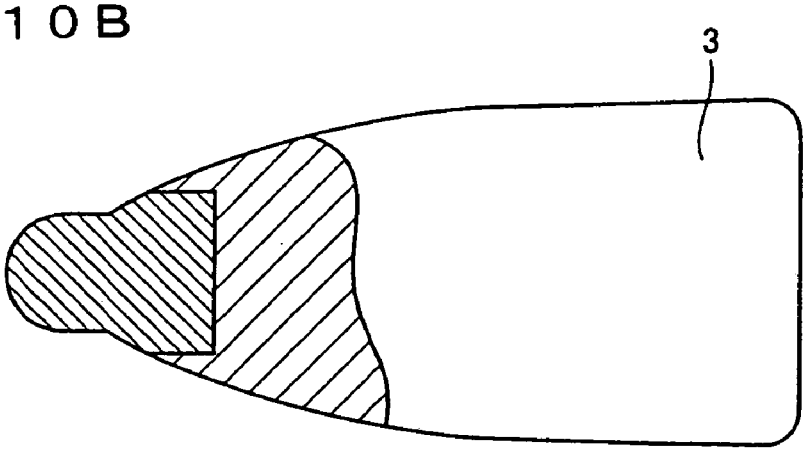

FIG. 10 is a view showing an example of a configuration of a split plug produced by an assembly method. In FIG. 10A a plug nose rolling portion is formed cylindrically and assembled. On the other hand, in FIG. 10B a plug nose rolling portion is assembled so that it forms a cylindrical portion and a shoulder portion.

When the plug has a cylindrical plug nose rolling portion shown in FIG. 10A, damage in a reeling portion is increased. Thus, it is preferable to appropriately select the plug nose rolling portion shown in FIG. 10A or FIG. 10B in accordance with piercing conditions. Further, it is preferable that the plug nose rolling portion can be replaced.

As base materials of the plug 0.5% Cr—1.5% Ni—3.0% W series alloys are preferably used. In this case, the scale thickness of the base material is preferable in a range of 200 μm–1000 μm from viewpoints of adherence of a scale and the service life of the plug. Further, as a member used in a plug nose rolling portion, a high strength steel containing W and Mo, a Nb alloy of Nb—10% W—2.5% Zr, or a Mo alloy of Mo—0.5% Ti—0.08% Zr is preferably used. This is because these alloys can sufficiently satisfy high temperature strength required.

Further, as a member used in the plug nose rolling portion a member having a base material with a thick scale can also be used. Heat resistance can be ensured by covering a surface of a thick scale-formed member and dissolution of the plug is effectively suppressed. Additionally, the thick scale acts on lubricating properties in piercing.

When a thick scale is formed, it is preferable that the scale thickness of the member is set to 1.5 times to 3 times a scale thickness of the base material. When the scale thickness is less than 1.5 times its heat resistance cannot be ensured, and when it exceeds 3 times a decrease in the diameter of the member is generated whereby mounting of the member becomes difficult.

The scale processing of the present invention is not particularly necessary to limit a type of a furnace used and may be carried out by use of a typical heat treatment furnace. The scale processing may be performed at a temperature range of for example 1000° C.–1100° C., the scale thickness can be controlled by its processing time.

Concrete contents of the first and second methods of the present invention will be described based on examples hereinbelow.

EXAMPLE 1

In Example 1 effects of the first method of the present invention was confirmed by piercing rolling using a model mill. A 2-zone type plug and a plug having a shape shown in FIG. 3 were prepared as plugs used and the dimensions of the respective portions of the plugs were shown in Table 1. The 2-zone type plug was used as one type (F in Table 1). Any plugs were comprised of 0.5% Cr—1.5% Mo—3.0% W series stainless steels as materials.

As main rolls in a model mill four types (one barrel type and three cone types) of the rolls in which an outer diameter of a gorge portion is 410 mm, an inclination angle β is 0°, an inlet side interfacial angle formed by an inlet side plane of the main roll and a straight line in parallel with the pass line X—X, and an outlet side interfacial angle formed by an outlet side plane of the main roll and a straight line in parallel with the pass line X—X are both 3.5° in conditions where the intersecting angle γ was set to angles described later respectively were prepared.

Figure 11A:
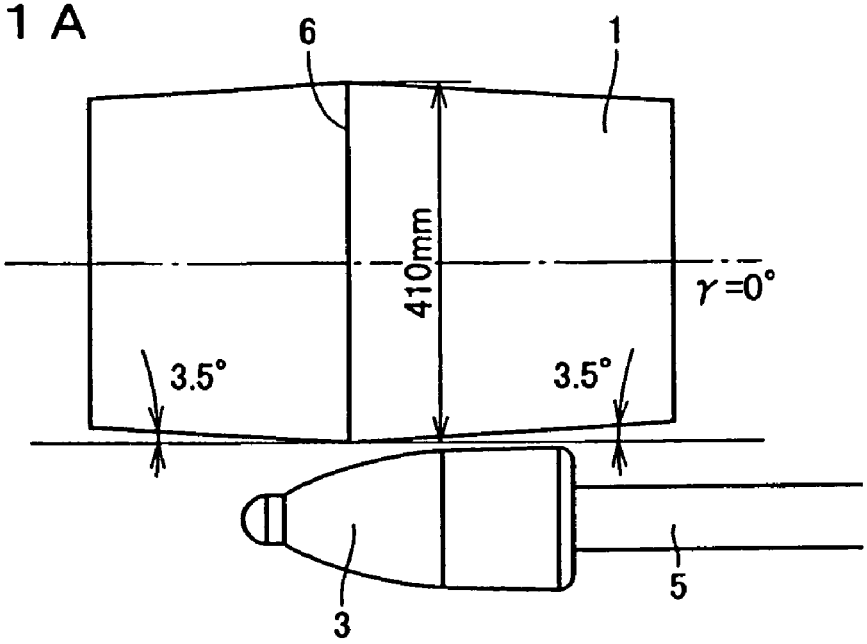
FIGS. 11A and 11B are views showing a configuration of the main roll of a model mill and setting conditions for a plug.
Figure 11B:
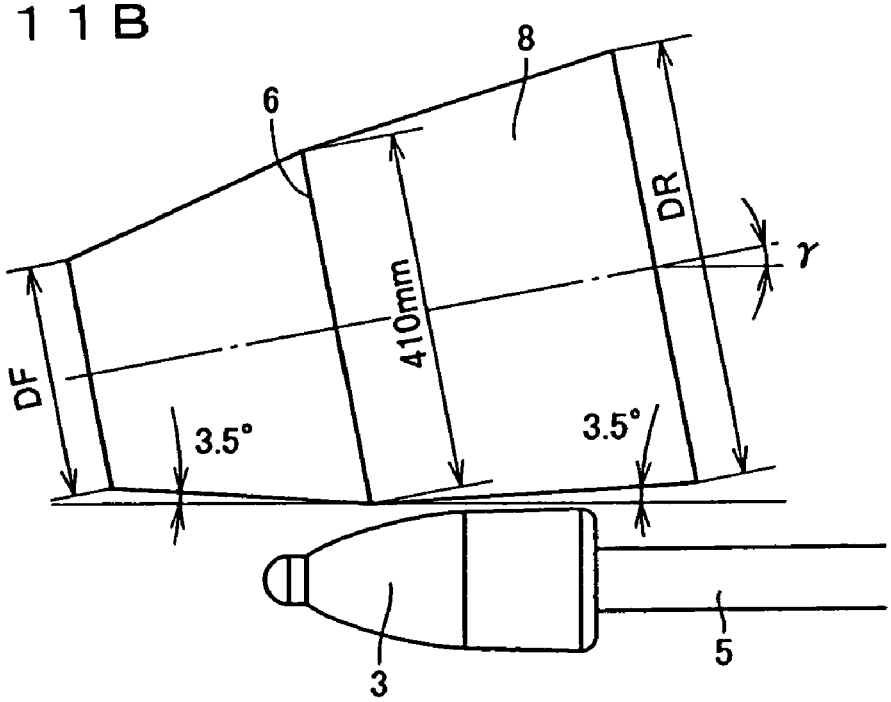

FIG. 11 is a view showing a configuration of the main roll of a model mill and setting conditions for a plug. Particularly, FIG. 11(*a*) shows a case of a barrel type roll, and FIG. 11(*b*) shows a case of a cone type roll. It is noted that the description of concrete dimensions was omitted, but an inlet side diameter DF and an outlet side diameter DR of the cone type main roll shown in FIG. 11(*b*) were set to be different from each other every intersecting angles γ (5°, 10°, and 15°).

Prepared plug and main rolls were set to a model mill. Then a piercing rolling test in which a billet consisting of a 18% Cr—8% Ni—1% Nb austenitic stainless steel having an outer diameter of 70 mm and an length of 300 mm was heated to 1250° C. to obtain a hollow tube stock having an outer diameter of 74 mm, a wall thickness of 5.8 mm and a length of 930 mm, was carried out. This 18% Cr—8% Ni—1% Nb austenitic stainless steel was selected as a material having the poorest hot-workability among austenitic stainless steels having less hot-workability.

In the piercing rolling test all inclination angles β of the main roll were set to 10°, and the intersecting angles γ were set to 5°, 10°, and 15 respectively. Further, the reductions at plug nose PDR were changed to five steps of 3%, 4%, 5%, 6% and 7%. Then the shortest distances RO and ROP between the mail rolls and the set size PL of the plug lead (shown in FIG. 8) are shown in Table 2.

Test results are shown in Table 3. In cases where plugs (B to D), which satisfy the conditions defined by the present invention, even if a reduction at plug nose PDR is set to 3%, which is low, uncompleted engagement is not generated and a hollow tube stock having no inside defects is obtained.

On the contrary, in cases where plugs (A, E and G) and a 2-zone type plug (F), which do not satisfy the conditions defined by the present invention were used, all plugs having the reduction at plug nose of 3% generate uncompleted engagement even if the reduction at plug nose was increased to 4% or more a certain plug generates uncompleted engagement. Further, for a plug (H), which does not satisfy the above-mentioned expressions (1) and (2), the nose of the plug is dissolved in any conditions.

Additionally, in cases where plugs (B to D), which satisfy the conditions defined by the present invention were used, in a piercer in which the main roll is a barrel type and the intersection angle γ is 0°, the maximum value of the reduction at plug nose PDR at which inside defects are not generated is 6%. However, when a plug, which does not satisfy the conditions defined by the present invention, was used, its maximum value is 4%, which is low.

Further, in a piercer in which the main roll is a cone type and the intersection angle γ is 5°, the maximum value of the reduction at plug nose PDR at which inside defects are not generated is 7%. However, when a plug, which does not satisfy the conditions defined by the present invention, was used, its maximum value is 5%, which is low. This tendency is remarkable in a piercer having larger intersection angle γ. On the other hand, the reduction at plug nose PDR at which inside defects are not generated when a 2-zone type plug was used, is only 5% of cases of piercers having intersection angles of 10° C. and 15°.

TABLE 1

| | Sizes of the respective portions of plug | | | | | | | | | | d | (d/2 BD) | (L1 + L2) |
|---|---|---|---|---|---|---|---|---|---|---|---|---|---|
| Mark | D | d | L1 | L2 | L3 | L4 | θ4 | θ | r | R | BD | (R/L3) | d |
| A | 60.0 | 17.0 | 8.5 | 4..0 | 60.0 | 47.5 | 5.0 | 40 | 8.5 | 152.6 | 0.24 | *0.048 | *0.74 |
| B | | 15.0 | 7.5 | 5.0 | 62.5 | 45.0 | 6.0 | | 7.5 | 168.3 | 0.21 | 0.040 | 0.83 |
| C | | | | | 75.0 | 32.5 | | | | 245.8 | | 0.033 | |
| D | | 11.0 | 5.5 | 7.0 | | | 8.0 | | 5.5 | 264.4 | 0.16 | 0.022 | 1.14 |
| E | | | | | 80.0 | 27.5 | 9.5 | | | 381.2 | | *0.016 | |
| F | | *— | 4.2 | *— | 70.8 | 45.0 | 6.0 | | 7.5 | 214.9 | *— | *— | *— |
| G | | 25.0 | 5.5 | 7.0 | 80.0 | 27.5 | 9.5 | | 17.0 | 1552.0 | *0.36 | *0.009 | 0.50 |
| H | | 7.0 | 3.5 | | 82.0 | | | | 3.5 | 342.2 | *0.10 | *0.012 | 1.50 |

Note 1) Units of D, d, L1 to L4, r and R are "mm" and units of θr and θ are "°".
Note 2) Mark * shows out of range defined in the present invention.

TABLE 2

| Reduction at plug nose [PDR = {(BD − ROP)/BD} × 100(%)] | | | | | | | | | | | | | | |
|---|---|---|---|---|---|---|---|---|---|---|---|---|---|---|
| 3% | | | 4% | | | 5% | | | 6% | | | 7% | | |
| RO | PL | ROP | RO | PL | ROP | RO | PL | ROP | RO | PL | ROP | RO | PL | ROP |
| 61.5 | 50.0 | 67.9 | 61.2 | 47.5 | 67.2 | 60.8 | 45.0 | 66.5 | 60.4 | 42.5 | 65.8 | 60.1 | 40.0 | 65.1 |

Note) Units of RO, ROP and PL are "mm".

TABLE 3

| Intersection angle γ | | 0° | | | | | 5° | | | | | 10° | | | | | 15° | | | | |
|---|---|---|---|---|---|---|---|---|---|---|---|---|---|---|---|---|---|---|---|---|---|
| PDR (%) | | 3 | 4 | 5 | 6 | 7 | 3 | 4 | 5 | 6 | 7 | 3 | 4 | 5 | 6 | 7 | 3 | 4 | 5 | 6 | 7 |
| Plug mark | *A | M | ○ | x | x | x | M | ○ | ○ | x | x | M | ○ | ○ | ○ | x | M | ○ | ○ | ○ | x |
| | B | ○ | ○ | ○ | x | x | ○ | ○ | ○ | ○ | x | ○ | ○ | ○ | ○ | ○ | ○ | ○ | ○ | ○ | ○ |
| | C | ○ | ○ | ○ | ○ | x | ○ | ○ | ○ | ○ | ○ | ○ | ○ | ○ | ○ | ○ | ○ | ○ | ○ | ○ | ○ |
| | D | ○ | ○ | x | x | x | ○ | ○ | ○ | ○ | x | ○ | ○ | ○ | ○ | x | ○ | ○ | ○ | ○ | ○ |
| | *E | ○ | ○ | x | x | x | ○ | ○ | ○ | x | x | ○ | ○ | ○ | x | x | ○ | ○ | ○ | ○ | x |
| | *F | M | M | x | x | x | M | M | x | x | x | M | M | ○ | x | x | M | M | ○ | x | x |
| | *G | M | M | M | M | M | M | M | M | M | M | M | M | M | M | M | M | M | M | M | M |
| | *H | P | P | P | P | P | P | P | P | P | P | P | P | P | P | P | P | P | P | P | P |

Note 1) Mark * shows out of range defined in the present invention.
Note 2) Mark ○ shows no generation of inside scab.
Mark x shows generation of inside scab.
Mark M shows generation of incompleted engagement.
Mark P shows generation of dessolution in plug nose.

EXAMPLE 2

In Example 2 effects of the second method of the present invention were confirmed by the use of the same model mill. Three types of plugs to be used, having a shape shown in FIG. 3, were prepared. The sizes of the respective portions of the plugs were shown in Table 4.

The base materials of all plugs consist of 3.0% Cr—1.0% Ni series steels, and tensile strength of the base material was 30 MPa at 1100° C. Further, as a member of the nose rolling portion a member was used in which as the base materials a Nb alloy of Nb—10% W—2.5% Zr, a Mo alloy of Mo—0.5% Ti—0.08% Zr and four types of ferrous high strength steels were used and the a scale was formed on the respective base material.

As the physical properties of the plugs used tensile strengths of the plug nose rolling portions at 1100° C. and scale thicknesses of the base materials were measured and the results are shown in Tables 5 (1) to 5 (3). These scaling processes were carried out at a temperature range of 1000° C. to 1100° C. and the scale thicknesses were changed by controlling the processing time. As a scaling furnace a typical heat treatment furnace was used.

In a structure of the plug, its nose rolling portion was made replaceable and the plug splitting type was selected from the types shown in FIGS. 10(*a*) and 10 (*b*). Then examples of the split structures are divided into FIG. 10(*a*) or FIG. 10(*b*) and shown in Tables 5 (1) to 5 (3).

The main roll of the model mill was set by the same conditions as in the cone type roll used Example 1. In piercing rolling tests an inclination angle δ of the main roll was set to 10° and an intersection angle γ of the cone type main roll was set to 5°. Further, the reductions at plug nose PDR were changed to seven steps in a range 2.0% to 7.0%.

A billet used in the piercing rolling test was the same as in Example 1. A billet consisting of a 18% Cr—8% Ni—1% Nb austenitic stainless steel having an outer diameter of 70 mm and an length of 300 mm was heated to 1250° C. to obtain a hollow tube stock having an outer diameter of 74 mm, a wall thickness of 5.8 mm and a length of 930 mm. The test results are shown in Tables 5 (1) to 5 (3).

TABLE 4

| | Sizes of the respective portions of plug | | | | | | | | | | d | (d/2 BD) | (L1 + L2) |
|---|---|---|---|---|---|---|---|---|---|---|---|---|---|
| Mark | D | d | L1 | L2 | L3 | L4 | θr | θ | r | R | BD | (R/L3) | d |
| I | 60.0 | 7.0 | 3.5 | 7.0 | 82.0 | 27.5 | 9.5 | 4.0 | 3.5 | 342.2 | 0.100 | 0.027 | 1.50 |
| J | 60.0 | 5.0 | 2.5 | 8.0 | 82.0 | 27.5 | 7.5 | 4..0 | 2.5 | 251.7 | 0.071 | 0.020 | 1.50 |
| *K | 60.0 | 3.6 | 1.8 | 8.7 | 82.0 | 27.5 | 4.0 | 4.0 | 1.8 | 180.9 | *0.015 | *0.015 | 1.50 |

Note 1) Units of D, d, L1 to L4, r and R are "mm" and units of θr and θ are "°".
Note 2) Mark * shows out of range defined in the present invention.

TABLE 5 (1)

| | Plug nose rolling portion | | | Plug physical properties | | Piercing rolling conditions (intersection angle γ = 5°) | | | | | | |
|---|---|---|---|---|---|---|---|---|---|---|---|---|
| | | | | Tensile | Scale | PDR (%) | | | | | | |
| Plug mark | Split type | Member material | | strength (MPa) | thickness (μm) | 2.0 | 2.5 | 3.0 | 4.0 | 5.0 | 6.0 | 7.0 |
| I | (a) | 3Cr—1Ni | | *30 | 600 | P | P | P | P | P | P | x |
| | | 0.5Cr—1.5Mo—3W | | 55 | 100 | P | P | P | ○ | ○ | ○ | x |
| | | 1.5Cr—2.5Ni—0.1W—0.1Mo | | 50 | 400 | P | ○ | ○ | ○ | ○ | ○ | x |
| | | 0.5Cr—1.5Mo—3W | | 55 | 600 | P | ○ | ○ | ○ | ○ | ○ | x |

TABLE 5 (1)-continued

| Plug mark | Split type | Plug nose rolling portion Member material | Plug physical properties Tensile strength (MPa) | Scale thickness (μm) | Piercing rolling conditions (intersection angle γ = 5°) PDR (%) 2.0 | 2.5 | 3.0 | 4.0 | 5.0 | 6.0 | 7.0 |
|---|---|---|---|---|---|---|---|---|---|---|---|
| | | 1.5Cr—3Ni—0.5Mo—1W | 56 | 500 | P | ○ | ○ | ○ | ○ | ○ | x |
| | | 3Mn—3Mo—4W | 60 | 800 | P | ○ | ○ | ○ | ○ | ○ | x |
| | | Nb Alloy | >100 | | ○ | ○ | ○ | ○ | ○ | ○ | x |
| | | Mo Alloy | >100 | | ○ | ○ | ○ | ○ | ○ | ○ | x |
| | | 3Mn—3Mo—4W | 60 | 900 | P | ○ | ○ | ○ | ○ | ○ | x |
| | | 3Mn—3Mo—4W | 60 | 1500 | P | ○ | ○ | ○ | ○ | ○ | x |
| | (b) | 3Cr—1Ni | *30 | 600 | P | P | P | P | P | P | x |
| | | 0.5Cr—1.5Mo—3W | 55 | 100 | P | P | P | ○ | ○ | ○ | x |
| | | 1.5Cr—2.5Ni—0.1W—0.1Mo | 50 | 400 | P | ○ | ○ | ○ | ○ | ○ | x |
| | | 0.5Cr—1.5Mo—3W | 55 | 600 | P | ○ | ○ | ○ | ○ | ○ | x |
| | | 1.5Cr—3Ni—0.5Mo—1W | 56 | 500 | P | ○ | ○ | ○ | ○ | ○ | x |
| | | 3Mn—3Mo—4W | 60 | 800 | P | ○ | ○ | ○ | ○ | ○ | x |
| | | Nb Alloy | >100 | | ○ | ○ | ○ | ○ | ○ | ○ | x |
| | | Mo Alloy | >100 | | ○ | ○ | ○ | ○ | ○ | ○ | x |
| | | 3Mn—3Mo—4W | 60 | 950 | P | ○ | ○ | ○ | ○ | ○ | x |
| | | 3Mn—3Mo—4W | 60 | 1200 | P | ○ | ○ | ○ | ○ | ○ | x |

Note 1) Mark * shows out of range defined in the present invention.

Note 2) Mark ○ shows no generation of inside scab.

Mark x shows generation of inside scab.

Mark P shows generation of dissolution in plug nose.

Note 3) Thick scale in plug nose rolling portion shows a thick scale portion formed on the base material.

TABLE 5 (2)

| Plug mark | Split type | Plug nose rolling portion Member material | Plug physical properties Tensile strength (MPa) | Scale thickness (μm) | Piercing rolling conditions (intersection angle γ = 5°) PDR (%) 2.0 | 2.5 | 3.0 | 4.0 | 5.0 | 6.0 | 7.0 |
|---|---|---|---|---|---|---|---|---|---|---|---|
| J | (a) | 3Cr—1Ni | *30 | 600 | P | P | P | P | P | P | x |
| | | 0.5Cr—1.5Mo—3W | 55 | 100 | P | P | P | ○ | ○ | ○ | x |
| | | 1.5Cr—2.5Ni—0.1W—0.1Mo | 50 | 400 | P | ○ | ○ | ○ | ○ | ○ | x |
| | | 0.5Cr—1.5Mo—3W | 55 | 600 | P | ○ | ○ | ○ | ○ | ○ | x |
| | | 1.5Cr—3Ni—0.5Mo—1W | 56 | 500 | P | ○ | ○ | ○ | ○ | ○ | x |
| | | 3Mn—3Mo—4W | 60 | 800 | P | ○ | ○ | ○ | ○ | ○ | x |
| | | Nb Alloy | >100 | | ○ | ○ | ○ | ○ | ○ | ○ | x |
| | | Mo Alloy | >100 | | ○ | ○ | ○ | ○ | ○ | ○ | x |
| | | 3Mn—3Mo—4W | 60 | 900 | P | ○ | ○ | ○ | ○ | ○ | x |
| | | 3Mn—3Mo—4W | 60 | 2000 | P | ○ | ○ | ○ | ○ | ○ | x |
| | (b) | 3Cr—1Ni | *30 | 600 | P | P | P | P | P | P | x |
| | | 0.5Cr—1.5Mo—3W | 55 | 100 | P | P | P | ○ | ○ | ○ | x |
| | | 1.5Cr—2.5Ni—0.1W—0.1Mo | 50 | 400 | P | ○ | ○ | ○ | ○ | ○ | x |
| | | 0.5Cr—1.5Mo—3W | 55 | 600 | P | ○ | ○ | ○ | ○ | ○ | x |
| | | 1.5Cr—3Ni—0.5Mo—1W | 56 | 500 | P | ○ | ○ | ○ | ○ | ○ | x |
| | | 3Mn—3Mo—4W | 60 | 800 | P | ○ | ○ | ○ | ○ | ○ | x |
| | | Nb Alloy | >100 | | ○ | ○ | ○ | ○ | ○ | ○ | x |
| | | Mo Alloy | >100 | | ○ | ○ | ○ | ○ | ○ | ○ | x |
| | | 3Mn—3Mo—4W | 60 | 980 | P | ○ | ○ | ○ | ○ | ○ | x |
| | | 3Mn—3Mo—4W | 60 | 1200 | P | ○ | ○ | ○ | ○ | ○ | x |

Note 1) Mark * shows out of range defined in the present invention.
Note 2) Mark ○ shows no generation of inside scab.
Mark x shows generation of inside scab.
Mark P shows generation of dissolution in plug nose.
Note 3) Thick scale in plug nose rolling portion shows a thick scale portion formed on the base material.

TABLE 5 (3)

| Plug mark | Split type | Plug nose rolling portion: Member material | Plug physical properties: Tensile strength (MPa) | Plug physical properties: Scale thickness (μm) | Piercing rolling conditions (intersection angle γ = 5°) PDR (%): 2.0 | 2.5 | 3.0 | 4.0 | 5.0 | 6.0 | 7.0 |
|---|---|---|---|---|---|---|---|---|---|---|---|
| *K | (a) | 1.5Cr—2.5Ni—0.1W—0.1Mo | 50 | 400 | P | P | P | P | P | P | x |
| | | 0.5Cr—1.5Mo—3W | 55 | 600 | P | P | P | P | P | P | x |
| | | 1.5Cr—3Ni—0.5Mo—1W | 56 | 500 | P | P | P | P | P | P | x |
| | | 3Mn—3Mo—4W | 60 | 800 | P | P | P | P | P | P | x |
| | | Nb Alloy | >100 | | P | P | P | P | P | P | x |
| | | Mo Alloy | >100 | | P | P | P | P | P | P | x |
| | | 3Mn—3Mo—4W | 60 | 900 | P | P | P | P | P | P | x |
| | (b) | 1.5Cr—3Ni—0.5Mo—1W | 56 | 500 | P | P | P | P | P | P | x |
| | | 3Mn—3Mo—4W | 60 | 800 | P | P | P | P | P | P | x |
| | | Nb Alloy | >100 | | P | P | P | P | P | P | x |
| | | Mo Alloy | >100 | | P | P | P | P | P | P | x |
| | | 3Mn—3Mo—4W | 60 | 850 | P | P | P | P | P | P | x |

Note 1) Mark * shows out of range defined in the present invention.
Note 2) Mark ○ shows no generation of inside scab.
Mark x shows generation of inside scab.
Mark P shows generation of dissolution in plug nose.
Note 3) Thick scale in plug nose rolling portion shows a thick scale portion formed on the base material.

As can be seen from the results of Tables 5 (1) and 5 (2), in a case of plugs (I, J), which satisfy the relationships defined by the present invention and also satisfy tensile strength of its nose rolling portion at 1100° C. even if the reduction at plug nose PRD was set to a low level of 2.5%, no uncompleted engagement is generated whereby excellent tube stock could be obtained. However, in a member in which scale thickness was excessively thin or a thick scale was formed the occurrence of dissolution was found at a reduction at plug nose PRD of 2.0% to 2.5%.

On the other hand, as can be seen from the result of Table 5 (3), when a plug (K), which does not satisfy the conditions defined by the present invention, the noses of plugs were dissolved at any conditions. Particularly, even in the Nb alloy and the Mo alloy, the occurrence of dissolution was found in wide ranges.

INDUSTRIAL APPLICABILITY

According to the making method for a seamless metallic tube of the present invention, the rotary forging effect and the circumferential shearing strain can be significantly suppressed without generating uncompleted engagement of a billet. Accordingly, a product having reduced inside defects and excellent inside quality can be produced in high productivity. Further, by strengthening a plug nose rolling portion, a sharpened plug nose is obtained and an engagement limit can be increased. Additionally, a product further excellent in the inside quality can be efficiently produced. Accordingly, the present invention can be applied to wide fields of the piercing rolling of the seamless metallic tube.

What is claimed is:

1. A making method for a seamless metallic tube of piercing rolling a solid round billet of an outer diameter BD (mm) with a tilting roll type piercing rolling mill by use of a plug comprising:

a nose rolling portion comprising a cylindrical portion with an axial length of L2 (mm) whose outer diameter d (mm) is equalized in the axial direction or whose outer diameter d is increased toward a rear end of the cylindrical portion in the axial direction while having a half angle in a cone angle of 2° or less, and a nose spherical portion having a curvature radius of r (mm) and an axial length of L1 (mm), a working portion of an axial length of L3 (mm), continued to said nose rolling portion and formed by an arc rotating surface of a curvature radius of R (mm) so that an outer diameter is increased toward an axial rear end of the working portion, and a tapered cylindrical reeling portion of an axial length of L4 (mm), continued to said working portion and formed by a cone angle of 2 θ (°), so that an outer diameter is increased toward a maximum outer diameter D (mm) on the axial rear end of an reeling portion, wherein the relationships between the outer diameter d, the curvature radius R, and the axial lengths L1, L2 and L3 of said plug and the outer diameter BD of said solid billet satisfy all of the following expressions (1) to (3):

$$0.12 \leqq d/BD \leqq =0.35 \quad (1)$$

$$0.020 \leqq (d/2BD)/(R/L3) \leqq 0.046 \quad (2)$$

$$0.5d \leqq L1+L2 \leqq 3d \quad (3).$$

2. A making method for a seamless metallic tube according to claim 1, wherein a scale thickness of a base material forming said working portion and said reeling portion are 200 μm to 1000 μm.

3. A making method for a seamless metallic tube according to claim 2 wherein the nose rolling portion further comprises a member made from said base material, the member having a scale formed thereon, and a scale thickness in the plug nose rolling portion is in a range of 1.5 times to 3 times the scale thickness in said working portion and reeling portion.

4. A making method for a seamless metallic tube according to claim 1, wherein as said tilting roll type piecing rolling mill an intersection type, tilting roll type piercing rolling mill in which a shape of the main roll is a cone type, the distance between an axial center of the roll and a pass line is small on an inlet side and the distance between an axial center of the roll and a pass line is large on an outlet side, is used.

5. A making method for a seamless metallic tube according to claim 2, wherein as said tilting roll type piecing rolling mill an intersection type, tilting roll type piercing rolling mill in which a shape of the main roll is a cone type, the distance between an axial center of the roll and a pass line is small on an inlet side and the distance between an axial center of the roll and a pass line is large on an outlet side, is used.

6. A making method for a seamless metallic tube according to claim 3, wherein as said tilting roll type piecing rolling mill an intersection type, tilting roll type piercing rolling mill in which a shape of the main roll is a cone type, the distance between an axial center of the roll and a pass line is small on an inlet side and the distance between an axial center of the roll and a pass line is large on an outlet side, is used.

7. A making method for a seamless metallic tube of piercing rolling a solid round billet of an outer diameter BD (mm) with a tilting roll type piercing rolling mill by use of a plug having:

a nose rolling portion comprising a cylindrical portion with an axial length of L2 (mm) whose outer diameter d (mm) is equalized in the axial direction or whose outer diameter d is increased toward a rear end of the cylindrical portion in the axial direction while having a half angle in a cone angle of 2° or less, and a nose spherical portion having a curvature radius of r (mm) and an axial length of L1 (mm), a working portion of an axial length of L3 (mm), continued to said nose rolling portion and formed by an arc rotating surface of a curvature radius of R (mm) so that an outer diameter is increased toward an axial rear end of the working portion, and a tapered cylindrical reeling portion of an axial length of L4 (mm), continued to said working portion and formed by a cone angle of 2 θ (°), so that an outer diameter is increased toward a maximum outer diameter D (mm) on the axial rear end of an reeling portion, and in which tensile strength of at least said nose rolling portion at 1100° C. is 50 MPa or more, wherein the relationships between the outer diameter d, the curvature radius R, and the axial lengths L1, L2 and L3 of said plug and the outer diameter BD of said solid billet satisfy all of the following expressions (2) to (4):

$$0.06 \leqq d/BD \leqq = 0.12 \quad (4)$$

$$0.020 \leqq (d/2BD)/(R/L3) \leqq 0.046 \quad (2)$$

$$0.5d \leqq L1+L2 \leqq 3d \quad (3).$$

8. A making method for a seamless metallic tube according to claim 7, wherein said plug nose rolling portion is replaceable.

9. A making method for a seamless metallic tube according to claim 8, wherein a scale thickness of a base material forming said working portion and said reeling portion are 200 μm to 1000 μm.

10. A making method for a seamless metallic tube according to claim 7, wherein a scale thickness of a base material forming said working portion and said reeling portion are 200 μm to 1000 μm.

11. A making method for a seamless metallic tube according to claim 7, wherein as said tilting roll type piecing rolling mill an intersection type, tilting roll type piercing rolling mill in which a shape of the main roll is a cone type, the distance between an axial center of the roll and a pass line is small on an inlet side and the distance between an axial center of the roll and a pass line is large on an outlet side, is used.

12. A making method for a seamless metallic tube according to claim 8, wherein as said tilting roll type piecing rolling mill an intersection type, tilting roll type piercing rolling mill in which a shape of the main roll is a cone type, the distance between an axial center of the roll and a pass line is small on an inlet side and the distance between an axial center of the roll and a pass line is large on an outlet side, is used.

13. A making method for a seamless metallic tube according to claim 10, wherein the nose rolling portion further comprises a member made from said base material, the member having a scale formed thereon, and a scale thickness in the plug nose rolling portion is in a range of 1.5 times to 3 times the scale thickness in said working portion and reeling portion.

14. A making method for a seamless metallic tube according to claim 9, wherein the nose rolling portion further comprises a member made from said base material, the member having a scale formed thereon, and a scale thickness in the plug nose rolling portion is in a range of 1.5 times to 3 times the scale thickness in said working portion and reeling portion.

* * * * *